US006220170B1

(12) United States Patent
Theurer et al.

(10) Patent No.: US 6,220,170 B1
(45) Date of Patent: Apr. 24, 2001

(54) METHOD OF CORRECTING THE POSITION OF A RAILROAD TRACK

(75) Inventors: Josef Theurer, Vienna (AT); Gunther Oberlechner, Virginia Beach, VA (US)

(73) Assignee: Franz Plasser Bahnbaumaschinen-Industriegessellschaft m.b.H., Vienna (AT)

( * ) Notice: Subject to any disclaimer, the term of this patent is extended or adjusted under 35 U.S.C. 154(b) by 0 days.

(21) Appl. No.: 09/225,167

(22) Filed: Jan. 4, 1999

(30) Foreign Application Priority Data

Jan. 19, 1998 (AT) ..... 62/98

(51) Int. Cl.[7] ..... E01B 27/00

(52) U.S. Cl. ..... 104/10; 104/7.2; 104/12; 33/287

(58) Field of Search ..... 104/10, 12, 7.2; 33/287

(56) References Cited

U.S. PATENT DOCUMENTS

| | | | | |
|---|---|---|---|---|
| 3,545,384 | * | 12/1970 | Plasser et al. | 104/7.2 |
| 3,608,497 | * | 9/1971 | Plasser et al. | 104/7.2 |
| 3,687,081 | * | 8/1972 | Plasser et al. | 104/12 |
| 3,690,262 | * | 9/1972 | Plasser et al. | 104/7.2 |
| 3,706,284 | * | 12/1972 | Plasser et al. | 104/7.2 |
| 3,821,933 | * | 7/1974 | Plasser et al. | 33/287 |
| 3,875,865 | * | 4/1975 | Plasser et al. | 33/287 |
| 4,184,266 | * | 1/1980 | Hurni | 33/287 |
| 4,341,160 | * | 7/1982 | Nielsen | 104/7.2 |
| 4,531,053 | * | 7/1985 | Jaquet | 104/7.2 |
| 4,903,608 | * | 2/1990 | Theurer et al. | 104/7.2 |
| 4,947,757 | | 8/1990 | Theurer . | |
| 5,012,413 | * | 4/1991 | Sorka et al. | 104/7.2 |
| 5,031,542 | * | 7/1991 | Theurer | 104/12 |
| 5,157,840 | * | 10/1992 | Henttinen | 104/7.2 |
| 5,343,810 | * | 9/1994 | Theurer | 104/12 |
| 5,493,499 | | 2/1996 | Theurer et al. . | |

FOREIGN PATENT DOCUMENTS 0722013 of 0000 (EP) .

OTHER PUBLICATIONS

Leitcomputer Fur Stopfmaschinen by Bernhard. Lichtberger, In "Elsenbahningenieur" 44 (1993) 9, pp. 570–574.

* cited by examiner

*Primary Examiner*—S. Joseph Morano
*Assistant Examiner*—Lars A. Olson
(74) *Attorney, Agent, or Firm*—Horst M. Kasper

(57) ABSTRACT

A method of correcting the position of a railroad track composed of laterally adjacent track sections connected by branch tracks comprises the steps of measuring the position of each individual track section relative to an absolute reference system common to both track sections and registering high points, thereby forming actual position curves, while parallel thereto actual versines of the track position are detected by means of a further, machine-specific reference system. A target position curve is then generated which is common to the measured track sections and composed of the registered high points of the individual measured track sections and design sections, located between said high points, which smoothen the trace of the actual position curves. Track correction values are determined by obtaining the difference between the actual position curve of a respective track section and the common target position curve. The track position correction is implemented while synchronously lifting and/or laterally shifting the measured adjacent track sections according to the determined track correction values.

8 Claims, 1 Drawing Sheet y

METHOD OF CORRECTING THE POSITION OF A RAILROAD TRACK

BACKGROUND OF THE INVENTION

1. Field of the Invention

The present invention relates to a method of, and a tamping machine for, correcting the position of a railroad track composed of laterally adjacent track sections connected by branch tracks.

2. Description of the Prior Art

U.S. Pat. No. 4,947,757 describes the simultaneous operation by two tamping machines to work a switch or crossing section of a track, the switch section being formed by two track sections extending parallel to one another and a branch track connecting the same. The tamping machines are positioned adjacent to one another on the respective track sections and are working in tandem, being connected to one another by means of a control cable to enable the track lifting operation on both track sections to occur synchronously. This is to take into account the fact that the switch section, due to the branch track and the long ties connecting the two track sections, constitutes a structural unit, and that the switch section should consequently and expediently be lifted in its entirety only.

U.S. Pat. No. 5,493,499 discloses the use of the so-called "Global Positioning System" (GPS) in the context of correcting the position of a track by means of a tamping machine. A number of stationary satellite receivers are provided in place of the—heretofore customary—fixed track reference points, the position of the satellite receivers having been established with sufficient accuracy on an absolute basis. In addition to said stationary satellite receivers, a further satellite receiver is mobile together with the tamping machine on the track to be corrected. With the aid of this mobile satellite receiver, it is possible to convert the measured relative position of the track into absolute coordinates.

Finally, it is known from European patent application EP 0 722 013 A1 to measure the actual position of a track to be treated relative to a neighboring track by using the latter as a reference. Thus it is possible to reproduce the actual track position after it has been destroyed by the working operation of the machine.

SUMMARY OF THE INVENTION

It is the primary object of this invention to provide an improved method of correcting a railroad track, suitable particularly for adjacently situated track sections of a track switch or crossing section.

It is another object of the present invention to provide an improved tamping machine for correcting the position of such a railroad track.

The above and other objects are accomplished according to the invention with a method of the type described in the introduction which comprises the steps of measuring the position of each individual track section relative to an absolute reference system common to said track sections while registering high points, thereby forming actual position curves, and parallel thereto detecting actual versines of the track position by means of a further, machine-specific reference system; generating a target position curve, common to the measured track sections, which is composed of the registered high points of the individual measured track sections and design sections, located between said high points, which smoothen the trace of the actual position curves; determining track correction values by obtaining the difference between the actual position curve of a respective track section and the common target position curve; and implementing the track position correction while synchronously lifting and/or laterally shifting the measured adjacent track sections according to the determined track correction values.

With the above-mentioned steps of the method, it becomes possible for the first time to achieve exact and accurate agreement of the positions of the track sections linked by a branch track by first detecting all the high points of the entire switch section, said high points being critical for the track position correction, and then moving the track sections into a common plane in accordance with said high points. In doing so, it is essential to include the high points of both track sections, connected to one another, for creating a single, common target position curve, and to carry out the lifting of the track sections synchronously to accomplish the track position correction. Using this method, it becomes possible for the first time to bring into an optimal position even track switch or crossing sections which extend over a length of one to two kilometers.

According to another aspect of the present invention, there is provided a tamping machine for correcting the position of a railroad track, comprising undercarriages supporting the machine for mobility on the track, a vertically and/or laterally adjustable track lifting and lining unit, a machine-specific reference system for measuring versines of the track, and a further, absolute reference system for measuring the position of the track, consisting of a first GPS-receiver mounted on and mobile with the tamping machine and a second GPS-receiver disposed stationary with respect to the track.

According to yet another aspect of the invention, there is provided a tamping machine for correcting the position of a railroad track, comprising undercarriages supporting the machine for mobility on the track, a vertically and/or laterally adjustable track lifting and lining unit, a machine-specific reference system for measuring versines of the track, and a further, absolute reference system for measuring the position of the track, consisting of a laser transmitter disposed stationary with respect to the track and rotatable about a vertical axis and a laser receiver arranged on the tamping machine.

These embodiments make it possible in an advantageous way to implement the track position correction with already existing machines while requiring only minimal additional expenditure or refitting procedures.

BRIEF DESCRIPTION OF THE DRAWING

The above and other objects, advantages and features of the present invention will become more apparent from the following detailed description of certain now preferred embodiments thereof, taken in conjunction with the accompanying, somewhat schematic drawing wherein.

DETAILED DESCRIPTION OF PREFERRED EMBODIMENT

Figures 1, 2, 3, 4:
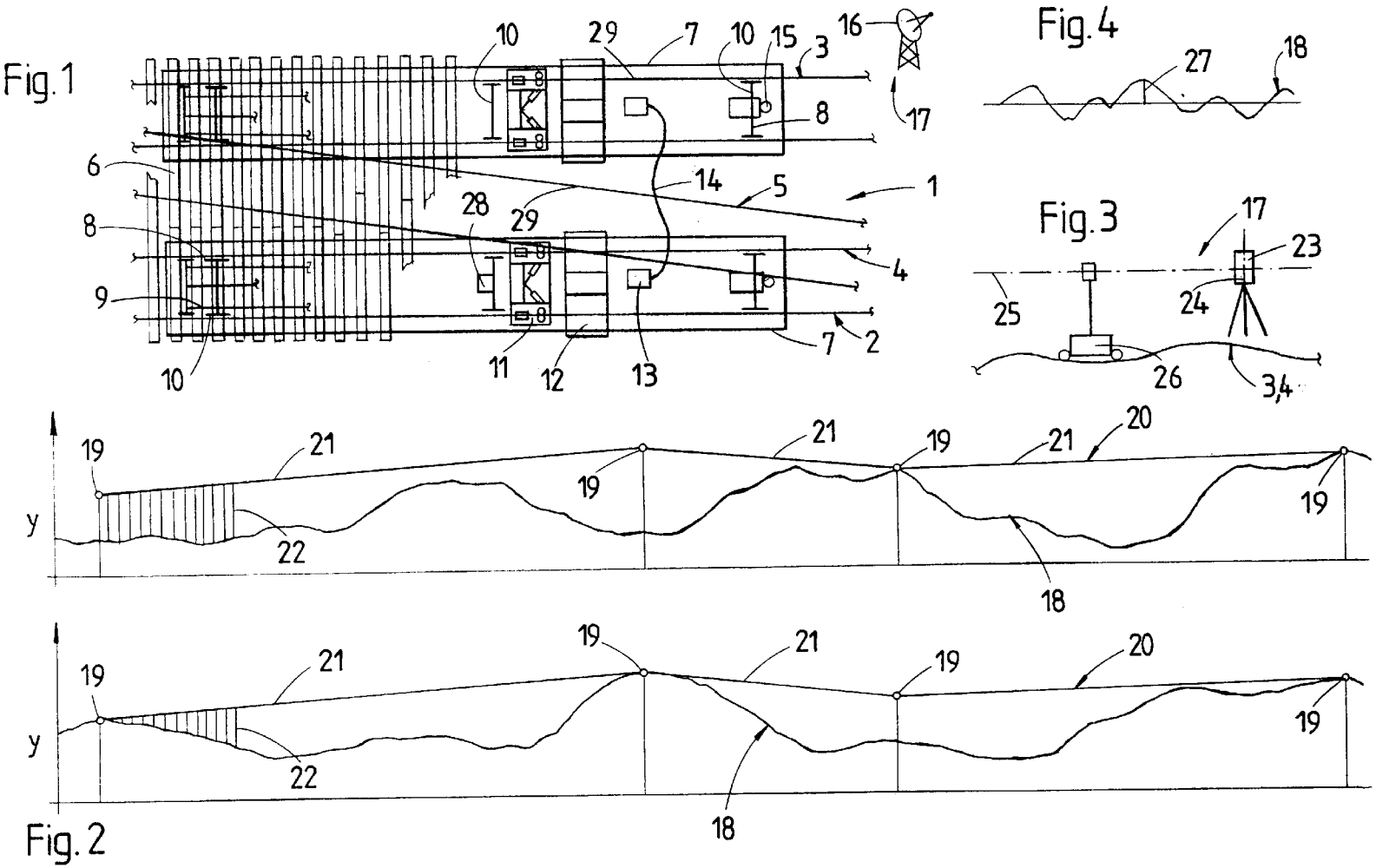
FIG. 1 is a greatly simplified top view of a track switch or crossing section, comprising two laterally adjacent track sections connected by a branch track, with two tamping machines arranged for carrying out a track position correction.
FIG. 2 is an actual position curve, having high points, and a target position curve for each track section, respectively.
FIG. 3 is a representation, again greatly simplified, of another embodiment of the invention.
FIG. 4 is an enlarged view of a small portion of an actual position curve.

Referring now to the drawing and first to FIG. 1, there is shown a track switch section 1 of a railroad track 2. The switch section is composed of two track sections 3 and 4 which extend parallel to one another and are linked by an obliquely extending branch track 5. In the region of the latter, the two track sections 3 and 4 are connected to one another by means of long ties 6 to which rails 29 of the track 2 are fastened.

For the purpose of working or tamping the track switch section 1, two tamping machines 7,7, each having undercarriages 8 for mobility on the track 2, are positioned side-by-side on track sections 3 and 4, respectively, for simultaneous operation. Each tamping machine 7 comprises a machine-specific reference system 9, a track lifting and lining unit 11 adjustable by means of drives, tamping units 12, and a control device 13. Each reference system 9 is formed by tensioned chords and has measuring axles 10 designed to roll on the track 2. Also provided is an odometer 28 which enables the measuring results to be assigned to a corresponding location. During the treatment of track switch section 1, the control devices 13 of the two tamping machines 7,7 are coupled to one another via a connecting cable 14. (Alternately, a radio or wireless connection or the like could be provided to serve the same purpose). In this way it is possible to synchronously lift both track sections 3 and 4 into the target position and simultaneously shift the track sections 3,4 into the correct lateral position. A joint working operation of this kind by two tamping machines is described in detail in US. Pat. No. 4,947,757 mentioned in the introduction.

One of the measuring axles 10 of the machine-specific reference system 9 is connected to a mobile GPS-receiver 15 which is part of an absolute reference system 17 also including a stationary GPS-receiver 16 located adjacent to the track 2. (The designation "GPS" refers to the "Global Positioning System", the principles of which are deemed to be common knowledge and which, therefore, is not further explained herein). The position of track 2 in relation to the stationary GPS-receiver 16 is known by coordinates. Use of a mobile GPS-receiver 15 and a stationary GPS-receiver 16 with known coordinates makes it possible to employ so-called differential GPS-measuring, the principles of which have also become known.

The implementation of the method of correcting the position of a track switch section 1 will be explained in detail below, with reference now also to FIG. 2.

A tamping machine 7 carries out a first measuring run on one (for example, the left-hand) track section 3, during which an actual position curve 18 of the track (see upper part of FIG. 2) is recorded by measuring versines with the aid of the machine-specific reference system 9. An example of such a versine is shown in FIG. 4. At the same time, absolute position data are measured by means of the absolute reference system 17, from which high points 19 (i.e. extreme high positions of track section 3) can be determined. Thus, the versine measurement accomplished by the machine-specific reference system 9 is tied into a vertical level measurement (differential GPS-measurement) on an absolute basis. The y-axis denotes the deviation of the actual track position with regard to the absolute base.

Subsequently, a similar measuring operation is carried out on the other (right-hand) track section 4, resulting in the formation of another actual track curve 18 visible in the bottom part of FIG. 2. In further sequence, a target position curve 20, common to both track sections 3,4, is formed by means of a suitable computing program, the target position curve being composed of the high points 19 of both track sections 3,4 and design sections 21 located there-between. The operation of smoothening the course of the versines, detected by the machine-specific reference system 9, of the actual position curve 18 for the purpose of forming the design sections 21 is also carried out by a computing program and is called electronic versine compensation. This is described in more detail, for example, in the journal "Der Eisenbahningenieur", September 1993, pages 570–574. During the smoothening process, the high points 19 found by the absolute reference system 17 are considered as fixed points with regard to the vertical position of track 2.

By obtaining the difference between the actual position curve 18 of the respective track section 3,4 and the common target position curve 20, the track correction values 22 required for correcting the track position are determined. In a concluding operation, the two track sections 3 and 4 are synchronously lifted by means of the two tamping machines 7 positioned side-by-side. The operation of lifting the track 2 is carried out according to the determined track correction values 22 associated with the respective actual position curve 18.

The above-described method, referring to correcting the vertical position of the track, can, of course, also be used for correcting the lateral position of track 2. To do so, it is merely necessary to chose fixed points on the actual position curve instead of the high points, and to designate said fixed points to be immovable during the correction of the lateral position of track 2.

As shown in the schematic representation in FIG. 3, the absolute reference system 17 may also be formed by a stationary laser transmitter 23 which is designed to be rotatable about a vertical axis 24, thereby creating a horizontal reference plane 25. A laser receiver 26 is connected to a tamping machine (not shown) and is mobile on the track section 3,4, detecting the deviations of the vertical position of track section 3,4 with regard to the reference plane 25. Thus it is possible to define, with reference to an absolute base, an actual position curve in connection with the machine-specific reference system of the tamping machine, as desired.

FIG. 4 shows a portion of an actual position curve 18 on an enlarged scale, clearly indicating the versines 27 detected by the machine-specific reference system 9.

What is claimed is:

1. A method of correcting the position of a railroad track composed of laterally adjacent track sections connected by branch tracks, which comprises the steps of:

(a) measuring the position of each individual track section relative to an absolute reference system common to said track sections while registering high points, thereby forming actual position curves, and parallel thereto (b) detecting actual versines of the track position by means of a further, machine-specific reference system, (c) generating a target position curve, common to the measured track sections, which is composed of the registered high points of the individual measured track sections and design sections, located between said high points, which smoothen the trace of the actual position curves, (d) determining track correction values by obtaining the difference between the actual position curve of a respective track section and the common target position curve, and (e) implementing the track position correction while synchronously lifting and/or laterally shifting the measured adjacent track sections according to the determined track correction values.

2. A tamping machine for correcting the position of a railroad track, comprising (a) undercarriages supporting the machine for mobility on the track, (b) a vertically and/or laterally adjustable track lifting and lining unit, (c) a machine-specific reference system for measuring versines of the track, and (d) a further, absolute reference system for measuring the position of the track, consisting of (1) a first GPS-receiver mounted on and mobile with the tamping machine and (2) a second GPS-receiver disposed stationary with respect to the track.

3. A tamping machine for correcting the position of a railroad track, comprising (a) undercarriages supporting the machine for mobility on the track, (b) a vertically and/or laterally adjustable track lifting and lining unit, (c) a machine-specific reference system for measuring versines of the track, and (d) a further, absolute reference system for measuring the position of the track, consisting of (1) a laser transmitter disposed stationary with respect to the track and rotatable about a vertical axis and (2) a laser receiver arranged on the tamping machine.

4. The tamping machine according to claim 3, wherein the laser transmitter creates a horizontal reference plane and wherein the laser receiver is mobile on the track section detecting the deviations of the vertical position of a track section relative to the reference plane.

5. The method according to claim 1 further comprising defining an actual position curve in connection with a machine-specific reference system.

6. The tamping machine according to claim 3 further comprising a control device connected to the absolute reference system.

7. The tamping machine according to claim 6 further comprising a connecting cable connected to the control device for connecting the reference system to a second control device of a second tamping machine for coupling the tamping machine and the second tamping machine and for lifting a second track synchronously with the track into a target position and for simultaneously shifting the track and the second track into a respective correct lateral position.

8. The tamping machine according to claim 3 wherein the laser receiver defines an actual position curve in connection with a machine-specific reference system.

* * * * *